United States Patent [19]

Ricketts

[11] 4,353,598

[45] Oct. 12, 1982

[54] METHOD OF BLASTING PILLARS WITH VERTICAL BLASTHOLES

[75] Inventor: Thomas E. Ricketts, Grand Junction, Colo.

[73] Assignee: Occidental Oil Shale, Inc., Grand Junction, Colo.

[21] Appl. No.: 141,604

[22] Filed: Apr. 18, 1980

[51] Int. Cl.[3] ..... E21C 41/10

[52] U.S. Cl. ..... 299/2; 102/312; 299/13

[58] Field of Search ..... 299/2, 13; 166/299; 102/23

[56] References Cited

U.S. PATENT DOCUMENTS

| | | | |
|---|---|---|---|
| 3,661,423 | 5/1972 | Garrett | 299/2 |
| 3,917,346 | 11/1975 | Janssen | 299/2 X |
| 3,917,348 | 11/1975 | Janssen | 299/2 |
| 3,980,339 | 9/1976 | Heald et al. | 299/2 |

*Primary Examiner*—Ernest R. Purser

*Attorney, Agent, or Firm*—Christie, Parker & Hale

[57] ABSTRACT

A fragmented permeable mass of formation particles is formed in an in situ oil shale retort in a subterranean formation containing oil shale. Formation is excavated to form a horizontally extending void in the subterranean formation and a support pillar of unfragmented formation is left in the void for supporting overlying unfragmented formation. The support pillar is prepared for explosive expansion by forming an array of explosive charges along the centerline of the pillar between its opposed free faces. The amount of explosive on each side of the centerline is about equal. Explosive is then detonated in the support pillar for expanding the pillar about equally toward both opposed free faces. Thereafter, explosive is detonated in unfragmented formation above and/or below the void for explosively expanding the formation toward the void to form the fragmented permeable mass of formation particles.

25 Claims, 10 Drawing Figures

METHOD OF BLASTING PILLARS WITH VERTICAL BLASTHOLES

BACKGROUND OF THE INVENTION

The presence of large deposits of oil shale in the Rocky Mountain region of the United States has given rise to extensive efforts to develop methods of recovering shale oil from kerogen in the oil shale deposits. The term "oil shale" as used in the industry is, in fact, a misnomer; it is neither shale nor does it contain oil. It is a formation comprising marlstone deposit containing an organic material called "kerogen" which, upon heating, decomposes to produce liquid and gaseous products. It is the formation containing kerogen that is called "oil shale" herein, and the carbonaceous liquid product is called "shale oil".

The recovery of liquid and gaseous products from oil shale deposits has been described in several patents, one of which is U.S. Pat. No. 3,661,423, issued May 9, 1972, to Donald E. Garrett, assigned to the assignee of this application, and incorporated herein by this reference. This patent describes the formation of a fragmented permeable mass of oil shale particles in a subterranean formation containing oil shale by undercutting a portion of the subterranean formation leaving unfragmented formation supported by a plurality of pillars. The pillars are removed, e.g., with explosive, and the unfragmented deposit is expanded to provide a permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen-supplying combustion zone feed into the retort on the trailing side of the combustion zone to advance the combustion zone through the fragmented mass. In the combustion zone, oxygen in the gaseous feed mixture is depleted by reaction with hot carbonaceous materials to produce heat and combustion gas. By the continued introduction of the oxyen-supplying feed into the combustion zone, the combustion zone is advanced through the fragmented mass. The effluent gas from the combustion zone passes through the retort on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products and a residual carbonaceous material. The resulting liquid and gaseous products pass to the bottom of the retort for collection.

It is desirable that the retort contain a reasonably uniform fragmented permeable mass of formation particles having a reasonably uniformly distributed void fraction so gases can flow uniformly through the retort, resulting in maximum conversion of kerogen to shale oil. A uniformly distributed void fraction in the direction perpendicular to the direction of advancement of the combustion zone is important to avoid channeling of gas flow in the retort. In preparation for the described retorting process, it is important that the formation be fragmented and displaced, rather than simply fractured, in order to create high permeability; otherwise, too much pressure differential is required to pass gas through the retort.

It has been proposed that oil shale be prepared for in situ recovery by first undercutting a portion of the formation to remove from about 5% to about 25% of the total volume of the in situ retort being formed, leaving the unfragmented portion supported by pillars. The pillars are then explosively expanded and after a time delay the unfragmented formation is explosively expanded, thereby filling the void created by the undercut with a fragmented permeable mass of particles.

To promote uniform void fraction distribution, pillars are explosively expanded first and then, after a time delay, the remaining unfragmented formation is explosively expanded either in a single explosion or in a further series of explosions in a single round.

The general art of blasting rock formations is discussed in *The Blasters' Handbook,* 15th Edition, published by E. I. duPont de Nemours and Compny, Wilmington, Del.

U.S. Pat. No. 4,146,272 issued Mar. 27, 1979, to Gordon B. French, and assigned to the assignee of the present application, describes a method for forming an in situ oil shale retort by expanding formation toward vertically spaced apart voids containing support pillars. The pillars are explosively expanded to spread the particles thereof uniformly across the void, and unfragmented formation adjacent the void is explosively expanded toward the voil before overlying, unsupported formation can cave into the void. Said U.S. Pat. No. 4,146,272 is incorporated herein by this reference.

Application Ser. No. 929,250, tilted METHOD FOR EXPLOSIVE EXPANSION TOWARD HORIZONTAL FREE FACES FOR FORMING AN IN SITU OIL SHALE RETORT, filed by me on July 31, 1978, now U.S. Pat. No. 4,192,554, describes the formation of a retort and recovery of liquid and gaseous products from the retort and is incorporated herein by reference.

There are several other patents which describe the recovery of liquid and gaseous products from oil shale which include a discussion regarding the removal of pillars from mined out areas.

U.S. Pat. No. 3,980,339, issued Sept. 14, 1976, to David D. Heald, describes forming a substantially horizontal in situ oil shale retort by mining out an area at the base of an oil shale deposit leaving overlying deposit supported by a plurality of pillars. The pillars are removed by drilling a plurality of holes into the pillars for receiving explosive. The holes are shown as being drilled a short distance into all four vertical faces of each rectangular pillar. Explosive is then placed into the holes wherein the type of explosive and sequence of setting off the charges is chosen so as to form rubble of a desired size.

U.S. Pat. No. 3,316,020, issued Apr. 25, 1967, to E. V. Bergstrom, relates to a process of in situ retorting of oil shale using roof failure methods. Horizontal slots called passageways are mined into the oil shale and cross-openings are then drilled between the slots. The cross-openings are drilled at an angle other than normal to the vertical wall of the slots, preferably at an angle of 45° to the plane of the vertical wall. The cross-openings are used as shotholes, with explosive placed along the length of each shothole to develop a desired amount of force. Explosive is detonated and a portion of the wall is displaced into the adjacent horizontal slot. This causes the roof to cave, thereby creating an in situ oil shale retort. Retorting is then commenced and shale oil products recovered.

U.S. Pat. No. 3,434,757, issued Mar. 25, 1969, to M. Prats, describes detonation of explosive in arches between parallel tunnels in oil shale to create a large unsupported roof area that collapses into the tunnels. The explosive is shown as being placed into one smaller "tunnel" drilled into each arch. Additional formation is fragmented by sequential detonation of a series of explosives to form permeable zones in the oil shale, and hot fluid is passed through the permeable zones for producing shale oil.

Although the prior art teaches the removal of pillars from within voids which have been mined into oil shale formation, there is a need in the art for a method which includes details of placement of explosive charges in the pillars for economically explosively expanding such pillars. Such a detailed process should include steps for promoting uniform distribution of pillar fragments into the void and for insuring that substantially the entire pillar is removed prior to explosive expansion of underlying or overlying unfragmented formation.

The uniform distribution of pillar fragments can result in the formation of a fragmented permeable mass of oil shale particles having a substantially uniformly distributed void fraction.

SUMMARY OF THE INVENTION

This invention relates to a method for forming a fragmented permeable mass of formation particles in an in situ oil shale retort in a subterranean formation containing oil shale. Formation is excavated to form at least one horizontally extending void in the subterranean formation. At least one support pillar of unfragmented formation having opposed free faces is left in the void and zones of unfragmented formation are left above and below the void and pillar. An array of explosive charges is formed in at least one of the zones of unfragmented formation for explosively expanding such a zone of unfragmented formation toward the void. An array of explosive charges is formed along the centerline between the opposed free faces of the support pillar, wherein the amount of explosive on each side of the centerline is about equal. Explosive in the support pillar is detonated for expanding the pillar about equally toward the opposed free faces and explosive is detonated in such a zone of unfragmented formation for explosively expanding the unfragmented formation toward the void to form a fragmented permeable mass of formation particles containing oil shale in the in situ oil shale retort.

BRIEF DESCRIPTION OF THE DRAWINGS

These and other features, aspects, and advantages of the present invention will become better understood with reference to the following description, appended claims, and accompanying drawings wherein:

DETAILED DESCRIPTION

Figure 1:
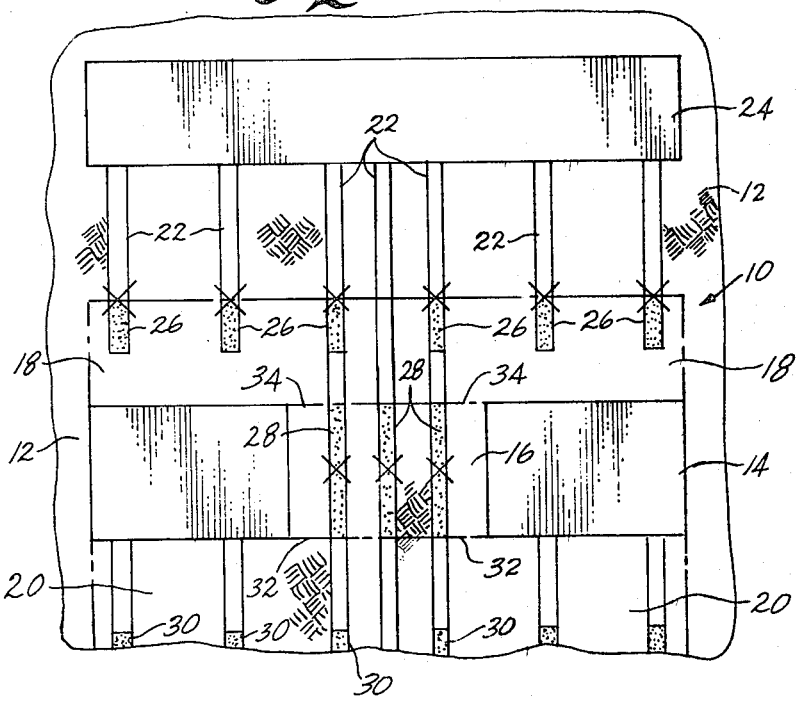
FIG. 1 is a fragmentary, semi-schematic vertical cross-sectional view showing a subterranean formation containing oil shale at an intermediate stage in preparation for explosive expansion for forming an in situ oil shale retort according to principles of this invention.

Referring to FIG. 1, there is shown a fragmentary semi-schematic horizontal cross-sectional view of an in situ oil shale retort 10 being formed in a subterranean formation 12 containing oil shale. The subterranean formation is at an intermediate stage of preparation for forming a fragmented permeable mass of formation particles in the in situ oil shale retort.

The in situ oil shale retort is formed by a horizontal free face system in which formation is excavated to form at least one horizontally extending void 14 in the subterranean formation 12. Zones of unfragmented formation are left above and below the void and at least one support pillar 16 of unfragmented formation is left in the void to provide temporary support for overlying unfragmented formation. For example, an upper zone 18 of unfragmented formation is left above the void and pillar and a lower zone 20 of unfragmented formation is left below the void and pillar.

Although the FIG. 1 only one support pillar is shown in the void 14, a plurality of pillars can be left in such a void if desired.

Support pillars can have various shapes and sizes. For example, the pillars can be generally rectangular in horizontal cross-section, i.e., they can have a length greater than their width. Alternatively, the pillars can be generally square in horizontal cross-section; that is, they can have a length about equal to their width. Although the pillars are generally rectangular of square, the edges can be broken off during excavation, thereby providing pillars having a more or less oval or circular shape.

An array of explosive charges is formed in at least one of the zones of unfragmented formation overlying or underlying the void and pillar for explosively expanding such a zone of unfragmented formation toward the void.

It is desired that the pillar 16 be explosively expanded in the instants prior to explosive expansion of such a zone of unfragmented formation overlying and/or underlying the void and pillar. Explosive expansion of the pillar provides a free face at the juncture of the pillar and unfragmented formation toward which the underlying and/or overlying unfragmented formation can expand.

Additional details of explosive expansion of both pillars and underlying and/or overlying unfragmented formation for forming an in situ retort can be found in U.S. Patent Application Ser. No. 75,810 titled "Method of Rubbling a Pillar" filed by me on Sept. 14, 1979, now U.S. Pat. No. 4,300,800 and in U.S. Patent Application Ser. No. 75,846 titled "Method of Rubbling Oil Shale" filed by me on Sept. 14, 1979. Both of these applications are incorporated herein by this reference.

In order to explosively expand the pillars, blastholes are formed in the pillars and loaded with explosive, forming an array of explosive charges. The explosive charges can then be detonated in a single round or series of rounds to expand the pillar toward the void.

Blastholes in which explosive charges are formed for explosively expanding a pillar can be drilled into the pillar in any of the three principal orthogonal directions, i.e., vertically through the height of the pillar or horizontally either through the width of the pillar or along the length of the pillar. Additionally, if desired, blastholes can be drilled at other angles.

However, because generally vertical blastholes can be used effectively to explosively expand underlying and overlying unfragmented formation, it can be desirable to use vertical blastholes for explosive expansion of the pillars, as shown in U.S. Pat. No. 4,192,554, incorporated hereinabove by reference. Additionally, when blasting toward a vertical free face, such as along the sides of a pillar, it has been found to be more efficient to use vertically extending columnar explosive charges than charges provided at other angles. When using vertical explosive charges, less explosive is required to fragment a given amount of formation.

Also, when vertical blastholes are used, workmen need to re-enter a void mined into the formation in order to form blastholes in the pillars in such a void. This improves the safety of the operation since the roof, i.e., the unfragmented formation overlying the void, can become increasingly unstable with time.

Referring again in FIG. 1, a plurality of vertical blastholes 22 are shown drilled into the unfragmented formation from an open base of operation 24, excavated in the subterranean formation. The base of operation 24 provides access to substantially the entire horizontal extent of the retort. Formation overlying the base of operation can be supported so that it is safe for use as a drilling site during preparation of the retort and additionally can be used as a control base during retorting operations. When there is no open base of operation or other void above the pillar in the subterranean formation, then the vertical blastholes can be drilled from the ground surface.

Alternatively, if another void is provided below the pillar, then the vertical blastholes can, if desire, be drilled upwardly into the pillar from the lower void.

To form explosive charges in the lower zone 20 of unfragmented formation, it can be convenient to drill vertical blastholes downwardly through the upper zone, the pillar, and into the lower zone. These blastholes, therefore, can be loaded with explosive for forming explosive charges in the upper zone, the lower zone, and additionally in the pillars. For example, the blastholes 22 are shown having an explosive charge 26 formed in the upper zone for expanding the upper zone, explosive charges 28 in the pillar for explosively expanding the pillar, and additionally explosive charges 30 in the lower zone for explosively expanding the lower zone. Stemming is provided in the blastholes between such explosive charges.

If desired, however, vertical blastholes can be drilled through the upper zone and into the pillar for forming explosive charges in the upper zone and in the pillar or, if desired, can be used for forming explosive charges only in the pillar.

To form a vertical columnar explosive charge in the pillar 16, explosive is placed in a vertical blasthole formed in the pillar with the explosive extending from about the bottom 32 of the pillar up to about the top 34 of the pillar; that is, from about the floor of the void 14 to its roof. Additionally, a detonator (shown by an "x") is placed in the explosive to provide for detonation of the explosive charges.

The location of explosive charges in the pillar, i.e., the pattern of an array of explosive charges, is important in order to provide the desired amount of fragmentation of the pillar and the desired distribution of pillar fragments across the void. It is desired that when expanding a pillar, for example, that the pillar is completely fragmented and that no portion of the pillar remains in the void as a stump or wall.

To promote explosive expansion of the center portion of a pillar, it can be desirable to form an array of vertical columnar explosive charges along the centerline between the opposed free faces of a pillar.

The term "centerline" is used for convenience. Since a line has only one dimension, the term "centerline" as used herein means a line or vertical plane passing through the center of the pillar.

It is preferred that these vertical explosive charges be formed exactly on the centerline with the amount of explosive in each charge being equally distributed on each side of the centerline. This enhances explosive expansion of the pillar equally toward both free faces.

It is desirable that the vertical columnar explosive charges formed along the centerline be at a distance from the centerline within plus or minus about 10% of the distance from the centerline to the free faces. If the charges are offset from the centerline by more than about 10% of the distance from the centerline to the free face, the expansion may be directed primarily toward the closer free face, resulting in an uneven distribution of fragments and possibly imcomplete fragmentation of the pillar.

It is possible, however, that even when the vertical explosive charges are placed exactly on the centerline so that the amount of explosive on each side of the centerline of the pillar is about equal, explosive expansion of the pillar can be preferentially directed toward one free face rather than equally toward both free faces. This can occur because of discontinuities in the unfragmented rock formation of the pillar and can cause a portion of the pillar to remain unfragmented in the void.

It can, therefore, be desirable to form additional vertical columnar explosive charges in portions of the pillar spaced apart laterally from the centerline to enhance complete explosive expansion of the pillar. Such additional explosive charges can further assure complete fragmentation of the pillar in case explosive charges nominally on the centerline are offset due to drilling or measurement discrepancies.

It is desirable when forming explosive charges along the centerline of the pillar and, additionally, laterally on each side of the centerline that the total amount of explosive placed on each side of the centerline in a pillar is about equal for enhancing explosive expansion of the pillar equally toward both free faces.

When forming explosive charges in a pillar, it is also preferred that the scaled depth of burial of each explosive charge be about equal. When the scaled depth of burial of each charge is equal, the amount of fragmentation and velocity of the fragments will be about the same in response to detonation of each charge. This will enhance uniform fragment distribution and permeability of the fragmented mass being formed in the retort.

The scaled depth of burial, as it applies to cratering or blasting to a vertical free face, is described in a paper by Bruce B. Redpath entitled "Application of Cratering Characteristics to a Conventional Blast Design", a copy of which accompanies this application and which is incorporated herein by this reference.

The scaled depth of burial of a point charge can be expressed in units of distance over weight of explosive to the $\frac{1}{3}$ power or preferably distance over energy of explosive to the $\frac{1}{3}$ power.

The scaled depth of burial of a line charge, such as a vertical columnar explosive charge described above, can be shown by the equation:

$$SDOB_{ln} = DOB_{ln} / \left(\frac{W}{S}\right)^{\frac{1}{2}} \quad (1)$$

Where $SDOB_{ln}$=scaled depth of burial of the vertical columnar explosive charge;

$DOB_{ln}$=actual depth of burial of the vertical columnar explosive charge;

W=total weight of explosive in the vertical columnar explosive charge;

S=unit length of the explosive charge.

The distance, which is referred to as actual depth of burial or burden distance in Equation (1), is measured from a free face of unfragmented formation toward which the unfragmented formation is to be explosively expanded to the axis of the columnar explosive charge used for explosively expanding the unfragmented formation. When using an array of decked charges, the burden distance for each of the charges of the second deck is measured to a new free face formed by detonation of the charges in the first deck. The weight or energy of the explosive is the total weight or energy of the column of explosive.

A relationship is developed by Redpath between point charges and line charges where $$[SDOB_{ln}]^2 = [SDOB_{pt}]^3 \quad (2)$$

Where $SDOB_{ln}$=scaled depth of burial of a columnar explosive charge;

$SDOB_{pt}$=scaled depth of burial of a point charge.

The desired range of the scaled depth of burial for point charges used for explosively expanding oil shale formation has been found to be between about 6 and about 12 millimeters per calorie to the $\frac{1}{3}$ power.

Practice of principles of this invention can be further understood by referring to FIGS. 2 through 10 which are horizontal cross-sectional views of support pillars of unfragmented formation left in a void excavated in a subterranean formation containing oil shale. Zones of unfragmented formation (not shown) are left above and below each pillar. Circles are used to show the placement of explosive charges in each pillar in preferred embodiments of this invention. Such circles, as well as the blastholes in FIG. 1, are drawn oversize for clarity.

Figure 2:
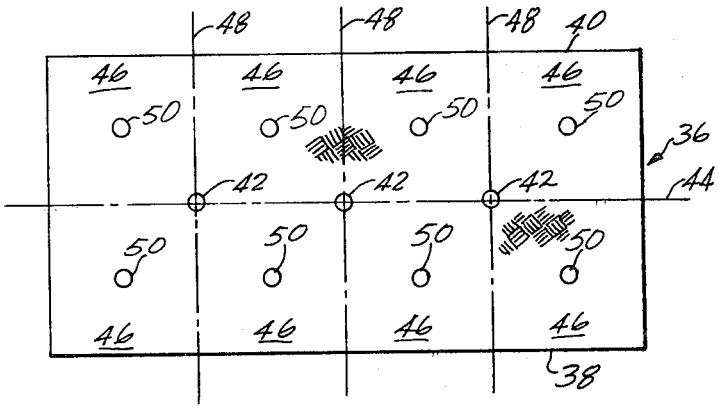
FIG. 2 is a semi-schematic horizontal cross-sectional view of a support pillar of unfragmented formation in a void showing an exemplary pattern of explosive charges.

Referring now to FIG. 2, there is shown in horizontal cross-section a generally rectangular support pillar 36 having opposed long free faces 38 and 40.

A plurality of uniformly spaced apart vertical columnar explosive charges 42 are formed in blastholes along the centerline 44 between the opposed long free faces of the pillar. A plurality of equal squares 46 are defined across the entire horizontal cross-section of the pillar by the centerline 44 and lines 48 which are perpendicular to the centerline. The lines 48 pass through the center of each explosive charge 42 and extend to the edges of the pillar.

An additional vertical columnar explosive charge 50 is formed in a blast hole at about the center of each square. Each explosive charge 50 in the center of the squares has about the same SDOB as the charges 42 along the centerline of the pillar.

Various sequences of detonation of the explosive charges can be used for explosively expanding the pillar 36. For example, the charges can be detonated all at once or, if desired, the explosive charges 50 nearer the free faces can be detonated first and, after a time delay, the explosive charges 42 along the centerline can be detonated.

When a time delay is used, the exlosive charges 42 expand formation toward new free faces formed by detonation of the charges 50. This must be taken into consideration when forming the charges to provide charges having equal scaled depth of burial.

Figure 3:
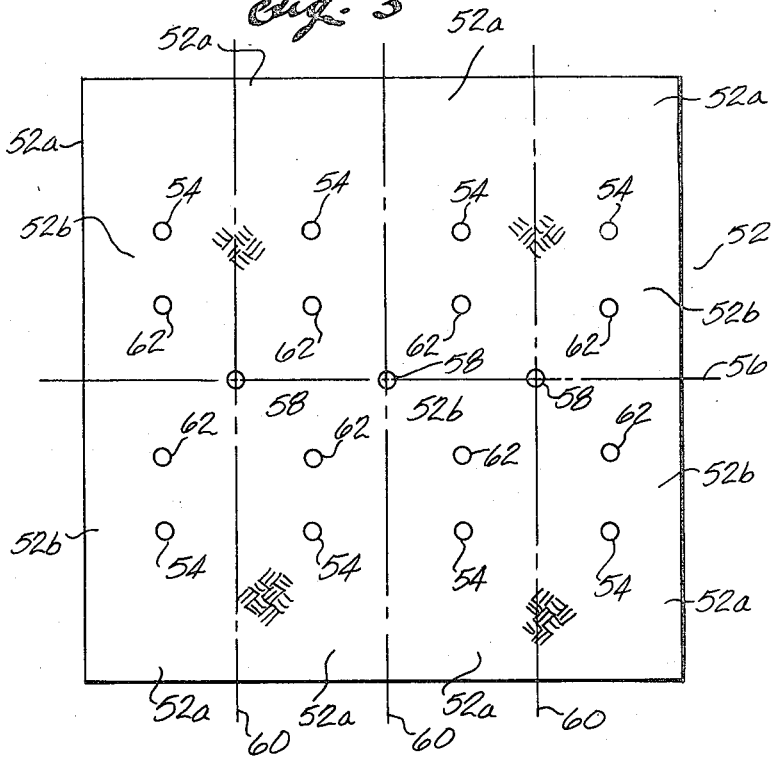
FIG. 3 is a semi-schematic horizontal cross-sectional view of another support pillar of unfragmented formation in a void showing another exemplary pattern of explosive charges.

Referring to FIG. 3, there is shown a horizontal cross-sectional view of a support pillar 52 of unfragmented formation having a generally square horizontal cross-section and which has an "aspect ratio" greater than about 0.5. The term "aspect ratio" has been coined for the ratio of one-half the width of a pillar divided by its height. The maximum aspect ratio for complete removal of a pillar without time delays in a round of explosive expansions for removing a pillar is somewhere between about 0.5 and about 1.0.

It can, therefore, be desirable to explosively expand the pillar 52 using decked charges; that is, the charges are detonated in a single round with time delays between some of the detonations.

In this embodiment, sides of the pillar are expanded into the void, leaving a central portion of the pillar standing. It is desired that the pattern of explosive charges formed in the remaining central portion provide for expanding all of the pillar without leaving a wall or stump of the pillar in the void.

An array of vertical columnar explosive charges is formed in the pillar 52 and a portion of the explosive charges is detonated for expanding a first portion of the pillar toward the void. For example, an array of explosive charges formed in the pillar can include two outer rows of explosive charges 54. The explosive charges 54 are detonated for expanding a first portion **52*a* of the pillar toward the void. The first portion 52*a* comprises the portion of the pillar between the outer rows of explosive charges 54 and the respective sides of the pillar. A second portion 52b** comprising the center of the pillar is left in the void and is thereafter explosively expanded for removing the entire pillar.

The second portion 2b of the pillar is generally rectangular in horizontal cross-section, having opposed long free faces which are formed by the detonation of the outer rows of charges 54. The opposed long free faces are located along vertical planes passing through the outer rows of charges 54 which are parallel to the centerline 56.

The second portion 52b of the pillar is shaped generally like the pillar 36 of FIG. 1, i.e., the second portion is of generally rectangular horizontal cross-section. It can, therefore, be desirable that the pattern of explosive charges remaining in the second portion of the pillar be about the same as the pattern of explosive charges formed in the pillar 36 illustrated in FIG. 2.

Therefore, a plurality of vertical columnar explosive charges 58 remains along the centerline of the second portion of the pillar between its newly formed opposed free faces. A plurality of equal squares are defined across the entire horizontal cross-section of the second portion by the centerline 56 and by lines 60 which pass through the center of each explosive charge 58 remaining along the centerline. The lines 60 extend to the edges of the second portion of the pillar and are perpendicular to the centerline. An additional explosive charge 62 remains at about the center of each equal square.

Explosive in these charges 58 and 62 is detonated in the second portion 52b of the pillar for expanding the second portion about equally toward the opposed long free faces.

Figure 4:
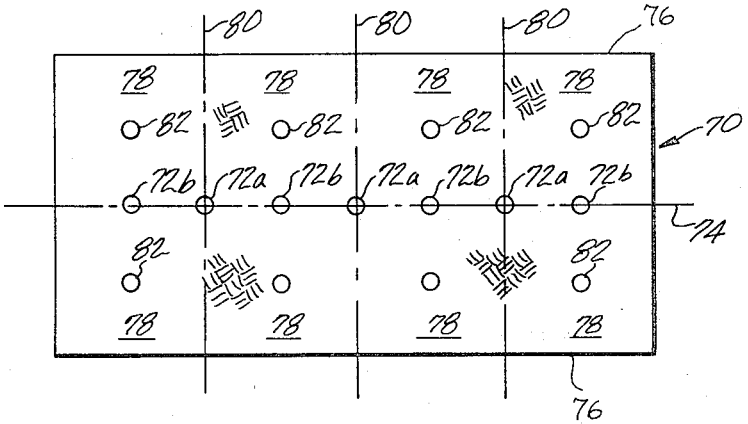
FIG. 4 is a semi-schematic horizontal cross-sectional view of another support pillar of unfragmented formation in a void showing yet another exemplary pattern of explosive charges.

Referring to FIG. 4, there is shown a generally rectangular support pillar 70 of unfragmented formation. A plurality of vertical columnar explosive charges 72 are formed along the centerline 74 between the opposed free faces 76 of the pillar. A plurality of equal squares 78 are defined across the entire horizontal cross-section of the pillar by the centerline 74 and by lines 80 which extend to the edges of the pillar. The lines 80 are perpendicular to the centerline of the pillar and pass through a first portion of the explosive charges, i.e., alternate explosive charges, designated 72a formed along the centerline.

An additional vertical columnar explosive charge 82 is formed at about the center of each square 78.

There is also provided a second portion of explosive charges designated 72b formed along the centerline at the intersection of the centerline and lines perpendicular to the centerline extending through the explosive charges 82. The augmented explosive charges along the centerline help assure destruction of the pillar.

Figure 5:
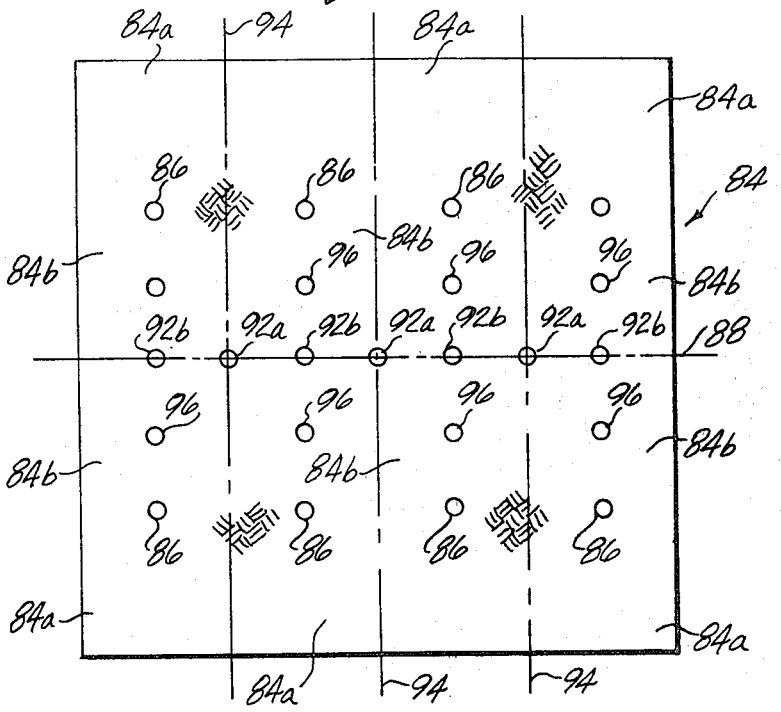
FIG. 5 is a semi-schematic horizontal cross-sectional view of yet another support pillar of unfragmented formation in a void showing yet another exemplary pattern of explosive charges.

Referring now to FIG. 5, there is shown a support pillar 84 of unfragmented formation having a generally square horizontal cross-section and which has an "aspect ratio" greater than about 0.5. It is, therefore, desirable to explosively expand the pillar 84 using decked charges.

An array of vertical columnar explosive charges is formed in the pillar 84 and a portion of the explosive charges is detonated for expanding a first portion of the pillar toward the void. For example, an array of explosive charges formed in the pillar can include two outer rows of explosive charges 86. The explosive charges 86 are detonated for expanding a first portion 84a between the outer rows and the respective free faces of the pillar toward the void. A second or center portion 84b of the pillar is left in the void and, after a short time delay, in the order of milliseconds, is explosively expanded for removing the entire pillar. The second portion 84b of the pillar is generally rectangular in horizontal cross-section, having opposed long free faces which are formed by the detonation of the charges 86. The opposed long free faces are located along vertical planes passing through the charges 86 parallel to the centerline 88.

The second portion of the pillar 84b is shaped generally like the pillar 70 of FIG. 4, i.e., the second portion is of generally rectangular horizontal cross-section. It can, therefore, be desirable that the pattern of explosive charges remaining in the second portion of the pillar be about the same as the pattern of explosive charges formed in the pillar 70.

Therefore, a plurality of vertical columnar explosive charges 92 remains along the centerline 88 of the second portion of the pillar. A plurality of equal squares are defined across the entire horizontal cross-section of the pillar by the centerline 88 and by lines 94 which extend to the edges of the pillar. The lines 94 are perpendicular to the centerline and pass through a first portion of the explosive charges designated 92a along the centerline.

An additional vertical columnar explosive charge 96 remains at about the center of each square. There is also provided a second portion of explosive charges designated 92b formed along the centerline at the intersection of the centerline and lines perpendicular to the centerline which extend between the explosive charges 96 on opposite sides of the centerline.

Figure 6:
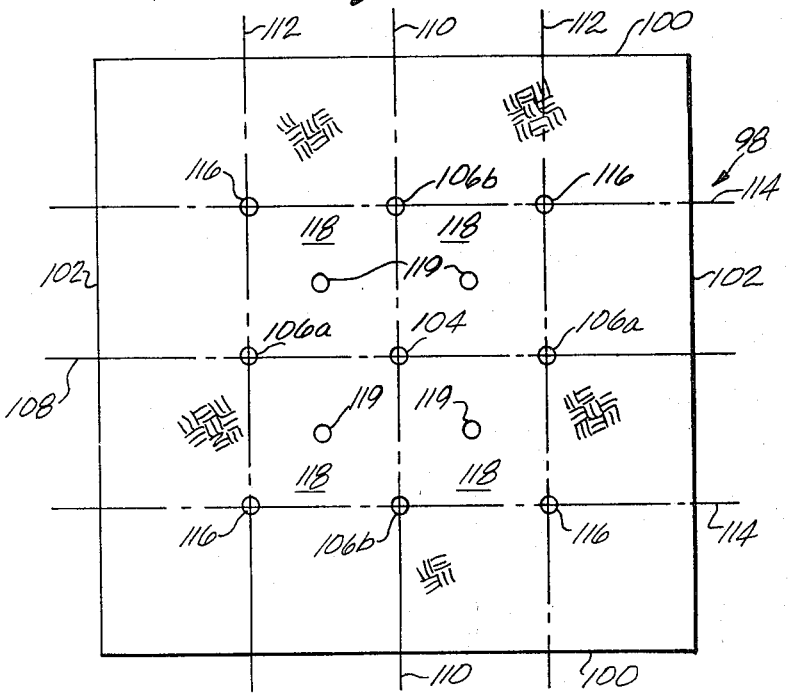
FIG. 6 is a semi-schematic horizontal cross-sectional view of another support pillar of unfragmented formation in a void showing as yet another exemplary pattern of explosive charges.

Referring to FIG. 6, there is shown a support pillar 98 generally square in horizontal cross-section and having a first pair of opposed free faces 100 and a second pair of opposed free faces 102.

A first vertical columnar explosive charge 104 is formed at the center of the pillar. Additionally, a plurality of second columnar explosive charges 106 are formed along a first centerline 108 between the first pair of opposed free faces and along a second centerline 110 between the second pair of opposed free faces. Sixteen equal squares are defined across the entire horizontal cross-section of the pillar by the first and second centerlines and lines 112 and 114. The lines 112 pass through the center of each second charge 106a on the first centerline, are perpendicular to the first centerline, and extend to the sides of the pillar. The lines 114 pass through the center of each second charge 106b on the second centerline, are perpendicular to the second centerline, and extend to the sides of the pillar.

A vertical columnar explosive charge 116 is formed at one corner of each of the four interior squares 118, which is located on a diagonal line from the center of the pillar to each of its corners. Additionally, a vertical columnar explosive charge 119 is formed in each of the four interior squares 118. The explosive charges 119 are located on each of the diagonal lines from the center of the pillar to each of its corners at a distance from the center of the pillar of about ½ the diagonal dimension of such an interior square.

The explosive charges are detonated in the support pillar 98 for expanding the pillar about equally toward all of its free faces. It can be desirable, for example, to detonate the charges in the pillar in a single round with a time delay between detonations. For example, the charges 116 and 106a and 106b surrounding the center of the pillar can be detonated first, followed by detonation of the charges 104 and 119 in the remaining center portion of the pillar.

The explosive charges formed in a pillar are provided so that the amount of explosive is about equally distributed radially around the center of the pillar. This enhances equal distribution of pillar fragments throughout the void.

Figure 7:
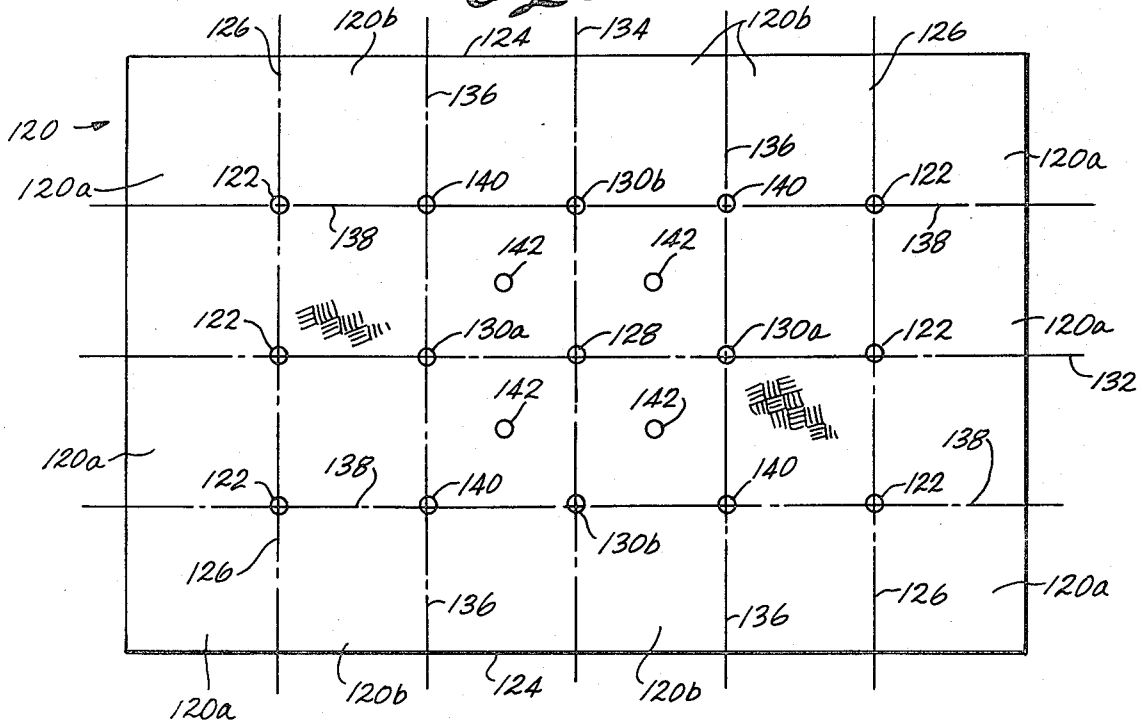
FIG. 7 is a semi-schematic horizontal cross-sectional view of another support pillar of unfragmented formation in a void showing yet another exemplary pattern of explosive charges.

Referring to FIG. 7, there is shown a support pillar 120 which is generally rectangular in horizontal cross-section.

An array of vertical columnar explosive charges is formed in the pillar and a portion of the explosive charges is detonated for expanding a first portion of the pillar toward the void. For example, an array of explosive charges formed in the pillar can include two outer rows of explosive charges 122 spaced apart from the ends of the pillar. The explosive charges 122 are detonated for expanding a first portion 120*a*, i.e., the ends, of the pillar toward the void. A second portion 120*b* of the pillar is left in the void and, after a time delay, explosively expanded for removing the entire pillar. The second portion 120*b* of the pillar has a generally square horizontal cross-section and a first and second pair of opposed free faces 124 and 126, the second pair of free faces 126 being formed upon explosive expansion of the ends of the pillar by detonation of explosive charges 122. Each of the free faces 126 of the second pair is located on a plane passing through the charges 122 at each end of the pillar.

The second portion of the pillar is shaped generally like the pillar 98 shown in FIG. 6. It can, therefore, be desirable that the pattern of explosive charges remaining in the second portion of the pillar be about the same as the pattern of explosive charges formed in the pillar 98.

Therefore, a first vertical columnar explosive charge 128 is at about the center of the pillar and a plurality of second columnar explosive charges 130 which are spaced apart from the first explosive charge are along a first centerline 132 between the first pair of opposed free faces and along a second centerline 134 between the second pair of opposed free faces 126.

A plurality of sixteen equal squares is defined across the entire horizontal cross-section of the second portion by the first and second centerlines and lines 136 and 138. Lines 136 extend to the edges of the pillar, are perpendicular to the first centerline, and pass through the center of each second charge 130*a* on the first centerline. Lines 138 extend to the edges of the pillar, are perpendicular to the second centerline, and pass through the center of each second charge 130*b* on the second centerline.

Additionally, a vertical columnar explosive charge 140 is at the corner of each of the four interior squares that are located on a diagonal line from the center of the second portion of the pillar to each of its corners. There is also provided a vertical columnar explosive charge 142 in each of the four interior squares located on each of the diagonal lines extending from the center of the second portion of the pillar to each of its corners. The explosive charge 142 is located at a distance from the center of the second portion of the pillar about ½ the diagonal dimension of such an interior square.

This pattern of explosive charges provides for approximately equal distribution of explosive radially about the center of the second portion of the pillar.

Figure 8:
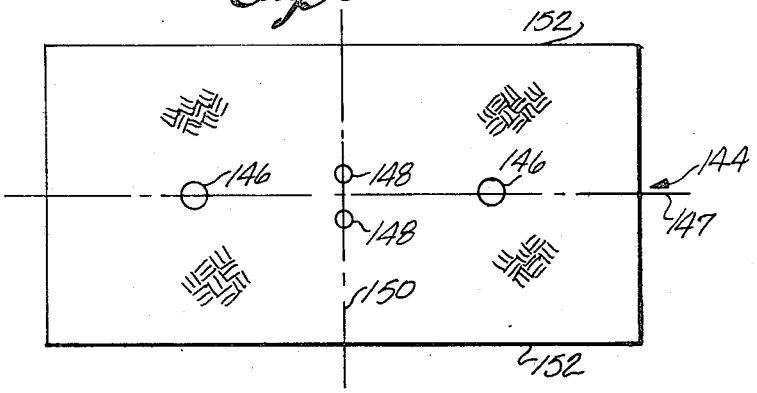
FIG. 8 is a semi-schematic horizontal cross-sectional view of another support pillar of unfragmented formation in a void showing yet another exemplary pattern of explosive charges.

Referring now to FIG. 8, there is shown a support pillar 144 of unfragmented formation having a generally rectangular cross-section. A pair of vertical columnar explosive charges 146 are formed on the centerline 147 of the pillar for providing an equal amount of explosive on each side of the centerline. Additionally, to enhance the distribution of explosive in the pillar, explosive charges 148 are formed outwardly from the centerline. The additional charges 148 are on a line 150 perpendicular to the centerline. It is preferred that the explosive charges 148 are no farther from the centerline than about 10% of the distance from the centerline to each of the opposed free faces 152. Having these blastholes within ±10% of the distance from the centerline to each of the opposed free faces promotes explosive expansion of the pillar toward both free faces.

Figure 9:
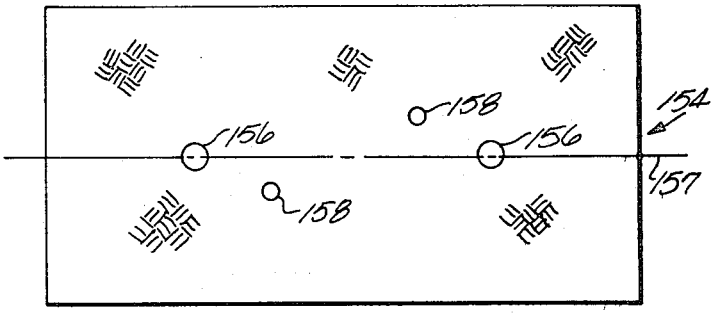
FIG. 9 is a semi-schematic horizontal cross-sectional view of yet another support pillar of unfragmented formation in a void showing yet another exemplary pattern of explosive charges.

Referring to FIG. 9, there is shown a support pillar 154 of unfragmented formation having a generally rectangular horizontal cross-section. Two vertical columnar explosive charges 156 are placed in the formation along the centerline 157 for providing an equal amount of explosive on both sides of the centerline and additionally an explosive charge 158 is provided on each side of the centerline. These additional explosive charges are near the first explosive charges 156 and offset towards the center of the pillar for providing an assymetrical motion of fragmented formation as the explosive charges are detonated.

Figure 10:
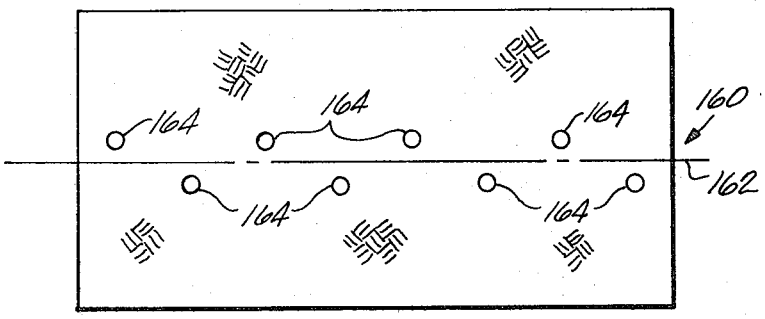
FIG. 10 is a semi-schematic horizontal cross-sectional view of yet another support pillar of unfragmented formation in a void showing yet another exemplary pattern of explosive charges.

Referring now to FIG. 10, there is shown a support pillar 160 of unfragmented formation having a generally rectangular horizontal cross-section. In this embodiment, instead of forming explosive charges directly along the centerline 162, a plurality of explosive charges 164 are formed on each side of the centerline. The charges on one side of the centerline are offset from changes on the other side of the centerline and, additionally, each of the charges is no farther from the centerline than about10% of the perpendicular distance from the centerline to the adjacent free face. This assures about equal amounts of explosive on each side of the centerline and accommodates drilling and measurement discrepancies.

The above description of a method for forming a fragmented permeable mass of formation particles in an in situ oil shale retort in a subterranean formation, including the description of removal of pillars by explosively expanding the pillars toward a void, is for illustrative purposes. Because of additional variations which will be apparent to those skilled in the art, the present invention is not intended to be limited to the particular embodiments described above. The scope of the invention is defined in the following claims.

What is claimed is:

1. A method for forming a fragmented permeable mass of formation particles in an in situ oil shale retort in a subterranean formation containing oil shale, comprising the steps of:

(a) excavating formation to form at least one horizontally extending void in the subterranean formation, leaving at least one support pillar of unfragmented formation in the void, and leaving zones of unfragmented formation above and below the void and pillar, such a pillar having opposed free faces;

(b) forming an array of explosive charges in at least one of such zones of unfragmented formation for explosively expanding such a zone of unfragmented formation toward the void;

(c) forming an array of spaced apart, vertical, columnar explosive charges substantially along the centerline between the opposed free faces of such a support pillar, the amount of explosive on each side of the centerline being about equal;

(d) detonating explosive in the support pillar for expanding the pillar about equally toward the opposed free faces; and (e) detonating explosive in such a zone of unfragmented formation for explosively expanding the unfragmented formation toward the void for forming a fragmented permeable mass of formation particles containing oil shale in the in situ oil shale retort.

2. The method according to claim 1 additionally comprising the step of forming at least one explosive charge on each side of the centerline, the total amount of explosive on one side of the centerline being about equal to the total amount of explosive on the other side of the centerline.

3. The method according to claim 1 wherein each such vertical columnar explosive charge in the array substantially along the centerline between the opposed free faces of such a support pillar has about the same scaled depth of burial.

4. A method for forming a fragmented permeable mass of formation particles in an in situ oil shale retort in a subterranean formation containing oil shale, comprising the steps of:

(a) excavating formation to form at least one horizontally extending void in the subterranean formation, leaving at least one support pillar of unfragmented formation in the void, and leaving zones of unfragmented formation above and below the void and pillar, such a pillar having opposed free faces;

(b) forming an array of explosive charges in at least one of such zones of unfragmented formation for explosively expanding such a zone of unfragmented formation toward the void;

(c) forming an array of explosive charges substantially along the centerline between the opposed free faces of such a support pillar by drilling vertical blastholes substantially along the centerline and loading the vertical blastholes with explosive, the amount of explosive on each side of the centerline being about equal;

(d) detonating explosive in the support pillar for expanding the pillar about equally toward the opposed free faces; and (e) detonating explosive in such a zone of unfragmented formation for explosively expanding the unfragmented formation toward the void for forming a fragmented permeable mass of formation particles containing oil shale in the in situ oil shale retort.

5. A method for forming a fragmented permeable mass of formation particles in an in situ oil shale retort in a subterranean formation containing oil shale comprising the steps of:

(a) excavating formation to form at least one horizontally extending void in the subterranean formation leaving at least one support pillar of unfragmented formation in the void, and leaving zones of unfragmented formation above and below the void and pillar, such a pillar having opposed free faces;

(b) forming an array of spaced apart vertical blastholes in such a zone of unfragmented formation, at least a portion of the blastholes extending into the pillar substantially along the centerline between the opposed free faces of the pillar;

(c) placing explosive into a portion of such vertical blastholes for forming an array of explosive charges in at least one of the zones of unfragmented formation for explosively expanding such a zone of unfragmented formation toward the void;

(d) placing explosive into blastholes formed substantially along the centerline of the support pillar for forming an array of substantially vertical columnar exlosive charges in the support pillar so that the amount of explosive on each side of the centerline is about equal;

(e) detonating explosive in the support pillar for expanding the pillar about equally toward the opposed free faces; and (f) detonating explosive in such a zone of unfragmented formation for explosively expanding the zone of unfragmented formation toward the void for forming a fragmented permeable mass of formation particles containing oil shale in the in situ oil shale retort.

6. The method according to claim 5 additionally comprising the steps of:

(a) forming at least one blasthole extending into the pillar on one side of the centerline and at least one blasthole extending into the pillar on the other side of the centerline; and (b) placing explosive into the blastholes on each side of the centerline so that the amount of explosive in the blastholes on each side of the centerline is about equal.

7. The method according to claim 5 wherein each vertical columnar explosive charge in the pillar has about the same scaled depth of burial.

8. A method for explosively expanding a generally rectangular support pillar of unfragmented formation in an excavation in a subterranean formation, such a pillar having opposed long free faces, comprising the steps of:

forming a plurality of spaced apart vertical columnar explosive charges substantially along the centerline between the opposed long free faces of the pillar, a plurality of equal squares being defined across the entire horizontal cross-section of the pillar by the centerline and lines perpendicular to the centerline which pass through the center of each explosive charge and extend to the edges of the pillar;

forming a vertical columnar explosive charge at about the center of each square; and detonating explosive in the support pillar for expanding the pillar about equally toward the opposed free faces.

9. The method according to claim 8 wherein each such explosive charge substantially along the centerline and at about the center of each square has about the same scaled depth of burial.

10. The method according to claim 8 wherein about an equal amount of explosive is provided on each side of the centerline.

11. A method for explosively expanding a support pillar having a generally square horizontal cross-section of unfragmented formation in an excavation in a subterranean formation comprising the steps of:

forming an array of spaced apart vertical columnar explosive charges in the pillar and detonating a portion of the explosive charges for expanding a first portion of the pillar toward the void, leaving a second portion of the pillar having a generally rectangular horizontal cross-section in the void, the second portion of the pillar having opposed long free faces, a plurality of such explosive charges remaining substantially along the centerline of the second portion of the pillar between the opposed long free faces, a plurality of equal squares being defined across the entire horizontal cross-section of the second portion of the pillar by the centerline and lines extending to the edges of the second portion of the pillar which are perpendicular to the centerline and pass through the center of each explosive charge along the centerline, an explosive charge being at about the center of each equal square; and detonating explosive in the second portion of the pillar for expanding the second portion about equally toward the opposed long free faces.

12. The method according to claim 11 wherein each such explosive charge substantially along the centerline and at about the center of each equal square has about the same scaled depth of burial.

13. The method according to claim 11 wherein about an equal amount of explosive is provided on each side of the centerline of the second portion of the pillar.

14. A method for explosively expanding a generally rectangular support pillar of unfragmented formation in an excavation in a subterranean formation, such a pillar having opposed long free faces, comprising the steps of:

forming a plurality of spaced apart vertical columnar explosive charges substantially along the centerline between the opposed long free faces of the pillar, a plurality of equal squares being defined across the entire horizontal cross-section of the pillar by the centerline and by lines perpendicular to the centerline which pass through a first portion of the explosive charges along the centerline, the perpendicular lines extending to the edges of the pillar;

forming a vertical columnar explosive charge at about the center of each square;

forming the second portion of the explosive charges along the centerline at about the intersection of the centerline and lines perpendicular to the centerline which extend between the explosive charges at about the center of adjacent squares; and detonating explosive in the support pillar for expanding the pillar about equally toward the opposed long free faces.

15. A method according to claim 14 wherein each such explosive charge substantially along the centerline and at about the center of each square has about the same scaled depth of burial.

16. The method according to claim 14 wherein about an equal amount of explosive is provided on each side of the centerline.

17. A method for explosively expanding a support pillar having a generally square horizontal cross-section of unfragmented formation in an excavation in a subterranean formation, comprising the steps of:

forming an array of spaced apart vertical columnar explosive charges in the pillar and detonating a portion of the explosive charges for expanding a first portion of the pillar toward the void, leaving a second portion of the pillar in the void, the second portion having a generally rectangular horizontal cross-section and opposed long free faces, a plurality of such explosive charges remaining substantially along the centerline of the second portion of the pillar between the opposed long free faces, a plurality of equal squares being defined across the entire horizontal cross-section of the pillar by the centerline and lines extending to the edges of the pillar perpendicular to the centerline which pass through a first portion of the explosive charges along the centerline, a vertical columnar explosive charge being at about the center of each square and at about the intersection of the centerline and lines perpendicular to the centerline which extend between explosive charges at about the center of adjacent squares; and detonating explosive in the second portion of the pillar for explosively expanding the second portion about equally toward the opposed long free faces.

18. The method according to claim 17 wherein each such explosive charge in the second portion of the pillar has about the same scaled point charge depth of burial.

19. The method according to claim 17 wherein the explosive charges in the second portion of the pillar provide for about an equal amount of explosive on each side of the centerline.

20. A method for explosively expanding a support pillar having a generally square horizontal cross-section of unfragmented formation in an excavation in a subterranean formation, such a support pillar having a first pair of opposed free faces and a second pair of opposed free faces, comprising the steps of:

forming a first vertical columnar explosive charge at about the center of the pillar and a plurality of spaced apart second vertical columnar explosive charges spaced apart from the first explosive charge substantially along a first centerline between the first pair of opposed free faces and substantially along a second centerline between the second pair of opposed free faces, sixteen equal squares being defined across the entire horizontal cross-section of the pillar by the first and second centerlines, by lines extending to the edges of the pillar perpendicular to the first centerline which pass through the center of each second charge on the first centerline and by lines extending to the edges of the pillar perpendicular to the second centerline, which pass through the center of each second charge on the second centerline;

forming a vertical columnar explosive charge at about the corner of each of the four interior squares located about on diagonal lines from the center of the pillar to each of its corners;

forming a vertical columnar explosive charge in each of the four interior squares located about on a diagonal line from the center of the pillar to its corner at a distance from the center of the pillar no greater than about one-half the diagonal dimension of such an interior square; and detonating explosive in the support pillar for expanding the pillar about equally toward the free faces.

21. The method according to claim 20 wherein each such vertical columnar explosive charge in the pillar has about the same scaled point charge depth of burial.

22. The method according to claim 20 wherein the amount of explosive in the pillar is about equally distributed radially around the center of such a pillar.

23. A method for explosively expanding a generally rectangular support pillar of unfragmented formation in an excavation in a subterranean formation comprising the steps of:

forming an array of spaced apart vertical columnar explosive charges in such a pillar and detonating a portion of the charges for explosively expanding a first portion of the pillar toward the void, leaving a second portion of the pillar in the void, the second portion having a generally square horizontal cross-section, and a first and second pair of opposed free faces, there being:

a first vertical columnar explosive charge at about the center of the pillar and a plurality of second vertical columnar explosive charges spaced apart from the first explosive charge substantially along a first centerline between the first pair of opposed free faces and substantially along a second centerline between the second pair of opposed free faces, sixteen equal squares being defined across the entire horizontal cross-section of the second portion by the first and second centerlines, lines extending to the edges of the pillar perpendicular to the first centerline which pass through about the center of each second charge on the first centerline and lines extending to the edges of the pillar perpendicular to the second centerline which pass through about the center of each second charge on the second centerline;

a vertical columnar explosive charge at about the corner of each of the four interior squares located on diagonal lines from the center of the second portion of the pillar to each of its corners;

a vertical columnar explosive charge in each of the four interior squares located about on a diagonal line from the center of the second portion of the pillar to its corner at a distance from the center of the second portion of the pillar no greater than about one-half the diagonal dimension of such an interior square; and detonating explosive in the second portion of the support pillar for expanding the pillar equally toward each of the opposed free faces.

24. The method according to claim 23 comprising forming the vertical columnar explosive charges in the second portion of the pillar wherein each such explosive charge has about the same scaled depth of burial.

25. The method according to claim 23 comprising forming the explosive charges in the second portion of the pillar for providing explosive about equally distributed radially about the center of the second portion of such a pillar.

* * * * *

UNITED STATES PATENT AND TRADEMARK OFFICE

CERTIFICATE OF CORRECTION

PATENT NO. : 4,353,598

DATED : October 12, 1982

INVENTOR(S) : Thomas E. Ricketts

It is certified that error appears in the above—identified patent and that said Letters Patent is hereby corrected as shown below:

Col. 4, line 13, "as yet" should read -- yet --;
Col. 4, line 51, "the" should read -- in --;
Col. 4, line 60, "of" should read -- or --;
Col. 5, line 43, "to" should read -- not --;
Col. 5, line 48, "in" should read -- to --;
Col. 5, line 62, "desire" should read -- desired --;
Col. 9, line 4, "2b" should read -- 52b --;
Col. 12, line 34, "changes" should read -- charges --;
Col. 12, line 36, "about10%" should read -- about 10% --;
Col. 14, line 9, "exlosive" should read -- explosive --.

Signed and Sealed this

*Fourteenth* Day of *December 1982*

[SEAL]

*Attest:*

GERALD J. MOSSINGHOFF

*Attesting Officer*

*Commissioner of Patents and Trademarks*